US008079191B2

(12) United States Patent
Martin

(10) Patent No.: US 8,079,191 B2
(45) Date of Patent: Dec. 20, 2011

(54) METHOD AND SYSTEM FOR COVERING FLAT ROOFS

(76) Inventor: Todd E. Martin, Kenosha, WI (US)

( * ) Notice: Subject to any disclaimer, the term of this patent is extended or adjusted under 35 U.S.C. 154(b) by 596 days.

(21) Appl. No.: 11/112,361

(22) Filed: Apr. 22, 2005

(65) Prior Publication Data

US 2005/0235591 A1 Oct. 27, 2005

Related U.S. Application Data

(60) Provisional application No. 60/564,437, filed on Apr. 22, 2004.

(51) Int. Cl.
*E04B 5/00* (2006.01)

(52) U.S. Cl. ..... 52/409; 52/314; 52/555; 428/41.7

(58) Field of Classification Search ..... 52/314, 52/408, 409, 555, 746.11, DIG. 16; 156/71; 428/40.1, 40.3, 41.7, 41.8, 42.2
See application file for complete search history.

(56) References Cited

U.S. PATENT DOCUMENTS

| | | | | | |
|---|---|---|---|---|---|
| 1,595,079 | A | * | 8/1926 | Fischer | 52/420 |
| 3,377,762 | A | * | 4/1968 | Chalmers et al. | 52/555 |
| 4,073,673 | A | * | 2/1978 | Raabe et al. | 156/244.12 |
| 4,091,135 | A | * | 5/1978 | Tajima et al. | 428/40.3 |
| 4,330,581 | A | | 5/1982 | Borgert | |
| 4,386,981 | A | * | 6/1983 | Clapperton | 156/71 |
| 4,421,807 | A | * | 12/1983 | Clausing et al. | 428/40.3 |
| 4,544,593 | A | | 10/1985 | Borgert | |
| 4,649,686 | A | * | 3/1987 | Backenstow et al. | 52/509 |
| 4,852,323 | A | | 8/1989 | Kartfilt | |
| 4,862,638 | A | * | 9/1989 | Stevenson | 43/114 |
| 4,872,296 | A | | 10/1989 | Janni | |
| 5,002,816 | A | | 3/1991 | Hofmann | |
| 5,088,259 | A | * | 2/1992 | Myers | 52/410 |
| 5,295,339 | A | * | 3/1994 | Manner | 52/518 |
| 5,660,004 | A | | 8/1997 | Blackmon | |
| 5,899,026 | A | | 5/1999 | Williams | |
| 5,966,883 | A | | 10/1999 | Krusec | |
| 6,105,324 | A | | 8/2000 | Krusec | |
| 6,134,856 | A | * | 10/2000 | Khan et al. | 52/536 |
| 6,141,932 | A | | 11/2000 | Tarrant | |
| 6,238,502 | B1 | * | 5/2001 | Hubbard | 156/71 |
| 6,401,412 | B1 | | 6/2002 | Cooper | |
| 6,470,644 | B2 | | 10/2002 | James | |
| 6,676,195 | B1 | | 1/2004 | Marriott | |
| 6,696,125 | B2 | * | 2/2004 | Zanchetta et al. | 428/40.1 |
| 6,892,782 | B1 | | 5/2005 | Mayle | |
| 7,146,771 | B2 | * | 12/2006 | Swann | 52/518 |
| 2003/0124292 | A1 | * | 7/2003 | Unterreiter | 428/40.1 |
| 2003/0126822 | A1 | * | 7/2003 | Gleeson | 52/604 |
| 2004/0172908 | A1 | * | 9/2004 | Swann | 52/518 |
| 2005/0126103 | A1 | * | 6/2005 | Scheirer et al. | 52/518 |

* cited by examiner

*Primary Examiner* — William V Gilbert
*Assistant Examiner* — Theodore Adamos
(74) *Attorney, Agent, or Firm* — Lesavich High-Tech Law Group, P.C.; Stephen Lesavich

(57) ABSTRACT

A method and system for covering flat roofs. The method and system include weather-proof flat roof material with plural sealing components that do not require an open flame (e.g., from a blow torch) to seal a first and second piece of weather-proof flat roof material together. The weather-proof flat material can be used as a base layer, a ply layer used between a base layer and a cap layer, a cap layer, as flashings, on walls or as a substrate layer for flat roofs.

17 Claims, 7 Drawing Sheets

METHOD AND SYSTEM FOR COVERING FLAT ROOFS

CROSS REFERENCES TO RELATED APPLICATIONS

This application claims priority to U.S. Provisional Application 60/564,437, filed Apr. 22, 2004, the contents of which are incorporated by reference.

FIELD OF THE INVENTION

This invention relates to flat roofs. More specifically, it relates to a method and system for covering flat roofs that does not require an open flame (e.g., from a blow torch) to create seals in weather-proof flat roofing materials.

BACKGROUND OF THE INVENTION

There are many types of buildings and other structures that have flat roofs. It is typically very difficult to protect buildings and other structures that have flat roofs from weather elements such as rain and snow. Flat roofs are typically covered with weather-proof flat roof materials of pre-determined widths and lengths. The weather-proof flat roof materials are unrolled and laid down in an overlapping pattern.

There are many problems associated with applying weather-proof flat roof materials to flat roofs. One problem is that most existing weather-proof flat roof materials require sealing of seams created by laying down the weather-proof flat roof materials in an overlapping pattern. This sealing is typically done by applying heat to the weather-proof flat roof materials from an open-flame heat source such as a blow-torch.

However, since most of the weather-proof flat roof materials are petroleum-based materials, the use of open-flames to seal the weather-proof flat roof materials has lead to many inadvertent fires and caused a number of environmental problems by releasing environmental pollutants and other toxic gases and materials into the atmosphere. As a result, many states have outlawed weather-proof flat roof materials that require sealing with an open-flame.

In addition, many insurance companies have refused to issue liability insurance policies to roofing companies and roofing contractors that continue to use weather-proof flat roof materials that require sealing with an open-flame. Such roofing companies and roofing contractors cannot bid on or receive certain contracts with such liability insurance polices.

Another problem is that some weather-proof flat roof materials for flat roofs are not suitable for certain areas due to their extreme weather. For example, flat roofs in Arizona or other hot climates where high temperatures and sunshine are routine all year long and rain is scarce, have certain characteristics. In contrast, flat roofs in the northern Minnesota where the temperature routinely falls below zero and must protect a structure from snow and ice during the winter months and against heat and humidity during the summer months have different characteristics.

Another problem is that weather-proof flat roof materials for flat roofs typically only come in large rolls of a predetermined size. For example, a roll of a flat roofing material may come in a coverage size of about "two square" or cover 210 square feet or 19.5 square meters. As is known in the art, a "square" used in the roofing industry is defined as about 100 square feet of roofing surface.

Such large rolls of materials often have to be cut to account for features on a flat roof such as drains, chimneys, ladders, roof openings, etc. These features require the weather-proof flat roof materials be cut and sealed around such features. Sealing such features is often difficult and often leads to leaks and other problems such as pooling or ponding of standing water.

Another problem is that weather-proof flat roof materials for flat roofs typically only come in a few colors such as black, gray, white, etc. It is often desirable to provide weather-proof flat roof materials in more than a few basic colors.

There have been attempts to solve some of the problems associated with flat roofs. For example, U.S. Pat. No. 5,660,004 entitled "Roofing system for protecting flat roofs or slightly sloped roofs, method of application of said new roofing system and method for reroofing using said new roofing system," that issued to Blackmon et al., teaches "This invention provides a new roofing system for protecting flat roofs or slightly sloped roofs. This invention also features a method of roofing and a method of reroofing using a new roofing system, said method comprising: (a) removing and relocating debris, including but not limited to leaves and loose roof gravel, from top of a building; (b) using an existing horizontal roof deck as a lower surface of said new roofing system; (c) fastening a horizontal roof support to said horizontal roof deck, and to any ceiling joists lying under the horizontal roof deck, using fasteners; (d) fastening metal sheets to the horizontal roof support using fasteners, said metal sheets inclining upwards from a number of longitudinal outer edges of the lower surface towards a central section of the new roofing system forming a left upper surface and a right upper surface, with a gap existing at the central section between the left upper surface and the right upper surface of the new roofing system; (e) using a number of ridge caps to cover said gap at the central section which is located between the left upper surface and the right upper surface after having placed a number of two-way vents for transmission of air and moisture on the lower surface and at the central section of said new roofing system; (f) setting air conditioning compressors above metal sheets after supplying additional support under said air conditioning compressors and above said metal sheets; (g) sealing existing functional vents, and additional vents that are needed, to the metal sheets at the left upper surface and at the right upper surface of the new roofing system; and (h) attaching prefinished compatible metal gutters to a number of outer edges of the new roofing system such that said metal gutters surround the metal sheets and, thus, the building above which said metal sheets are installed, utilizing a number of down spouts when appropriate and supplying a number of new down spouts when needed and connecting said number of down spouts to the metal gutters."

U.S. Pat. No. 4,544,593, entitled "Sealing strip," that issued to Borgert et al. teaches "A sealing strip is provided which is suitable for sealing flat roofs and engineering structures at outer corners. The sealing element is made of a weather-resistant elastomer or plastomer and comprises, in a zone positioned intermediate its ends, at least one pair of areas in the form of oppositely directed waves whose amplitudes and wave-lengths increase regularly from the center line of the strip towards its longitudinal edges so that said zone comprises a planar basal surface and an additional curved a planar sectorial surface corresponding to each wave. The wave-shape areas enable the sealing element to be smoothly laid around an outer corner without straining any areas of the strip.

U.S. Pat. No. 4,330,581, entitled "Sealing element," that issued to Borgert et al. teaches "A sealing element is provided which is suitable for sealing flat roofs and engineering structures. The sealing element is made of a water-resistant elastomer or plastomer, and comprises a lamelliform structure of substantially circular shape having from three to six waves, inclusively, distributed radially throughout the structure and around the entire circumference of the structure, the amplitudes of which waves increase regularly from the center of the structure towards the circumference. The undulations enable the sealing element to have an effective surface covering more than 360 degree without straining any region of the element."

However, none of these solutions solve all of the problems associated with flat roofs. Thus, it is desirable to provide weather-proof flat roof materials that overcome the problems associated with weather-proof flat roof materials for flat roofs.

SUMMARY OF THE INVENTION

In accordance with preferred embodiments of the present invention, some of the problems associated with covering flat roofs overcome. A method and system for covering flat roofs is presented.

The method and system include a weather-proof flat roof material with plural sealing components that do not require an open flame (e.g., from a blow torch) to seal a first and second piece of weather-proof flat roof material together. The weather-proof flat material can be used as a base layer, a ply layer used between a base layer and a cap layer, a cap layer, as flashings, on walls or as a substrate layer for flat roofs.

The foregoing and other features and advantages of preferred embodiments of the present invention will be more readily apparent from the following detailed description. The detailed description proceeds with references to the accompanying drawings.

BRIEF DESCRIPTION OF THE DRAWINGS

Preferred embodiments of the present invention are described with reference to the following drawings, wherein.

DETAILED DESCRIPTION OF THE INVENTION

Figure 1:
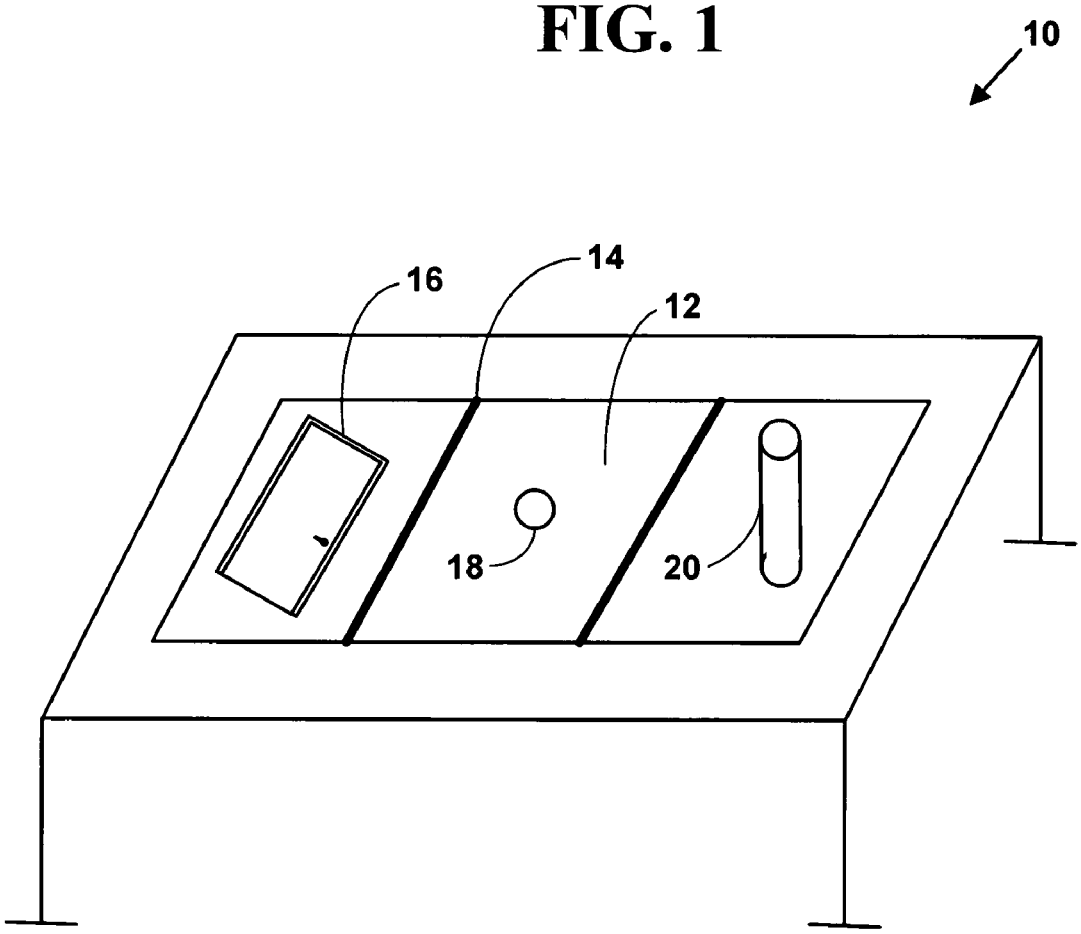
FIG. 1 is a block diagram illustrating an exemplary flat roof covering system.

FIG. 1 is a block diagram illustrating an exemplary flat roof covering system 10 for a building or structure with a flat roof. The exemplary flat roof covering system 10 includes plural overlapping pieces of a weather-proof flat roof material 12. The plural overlapping pieces of weather-proof flat roof material 12 include plural overlapping sealing components 14. The plural overlapping pieces of the weather-proof flat roof material 12 are altered for features including a roof entry feature 16, a roof drain 18, a chimney 20 and other roof features. However, the present invention is not limited to these components described for the flat roof covering system 10 and more, fewer or other components can also be used to practice the invention.

In one embodiment, the weather-proof flat roof material 12 includes protection for a flat roof against elements of weather including sunlight, wind, moisture, pressure, precipitation (e.g., rain, snow, sleet, freezing rain, etc.), temperature, etc.

In one embodiment, the weather-proof flat roof material 12 includes a first weather-proof side with a pre-applied adhesive applied to plural of sealing components 14 of a pre-determined width that will permanently bond to another sealing component of another piece of the weather-proof flat roof material 12 and a second weather-proof side with a pre-applied adhesive applied to plural sealing components 14 of a pre-determined width that will permanently bond to another sealing component of another piece of the weather-proof flat roof material 12. The weather-proof flat roof material 12 is used a base layer, a ply layer used between a base layer and a cap layer, a cap layer, as flashings, on walls or as a substrate layer for flat roofs. The weather-proof flat roof material 12 includes a first weather-proof side with a pre-applied adhesive applied to a plurality of sealing components 14 of a pre-determined width around a perimeter of the first weather-proof side.

In one embodiment of the invention, the weather-proof flat roof material 12 includes an elastomer. As is known in the art, a elastomer is type of polymer that exhibits rubber-like qualities. In another embodiment, the weather-proof flat roof material 12 includes a plastomer. As is known in the art, a plastomer is a type of flexible polymer with plural integral filaments.

In one embodiment, the pre-applied adhesive causes a chemical reaction to permanently bond two or more pieces of weather-proof flat roof material 12 to which the adhesive has been applied when the two or more pieces come in contact. In another embodiment, the pre-applied adhesive includes ruberoid bituminous compounds. However, the present invention is not limited to these embodiments and other pre-applied adhesives can also be used to practice the invention.

Figure 2A:
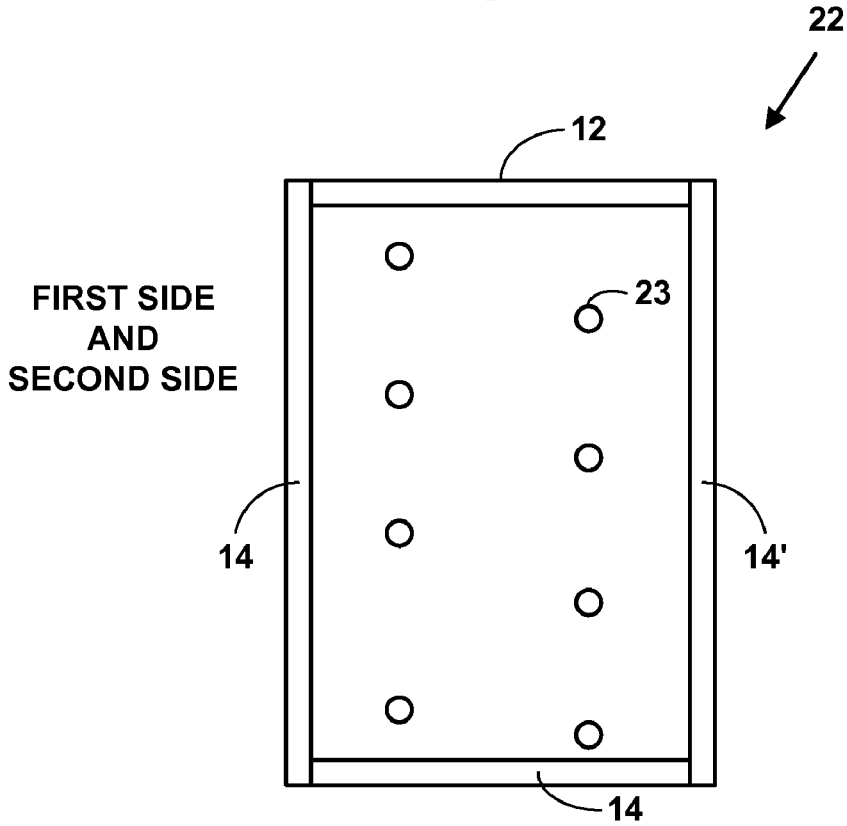
FIG. 2 is a block diagram illustrating additional details of a weather-proof flat roof material.
FIG. 2B is a block diagram 25 of side view of the weather-proof flat roof material; of FIG. 2 illustrating shallow troughs in the sealing components.

FIG. 2A is a block diagram 22 illustrating additional details of the weather-proof flat roof material 12. The weather-proof flat roof material 12 is provided in roll of material of a pre-determined size or as package of squares of a pre-determined size and includes plural sealing components 14 of a pre-determined width. In one embodiment, the pre-determined width ranges from four inches to six inches in width. In another embodiment it ranges from eighteen to thirty-six inches in length. In another embodiment, the pre-determined width comprises a total surface area for the first weather-proof side. In another embodiment, the pre-determined width comprises a total surface area for the second weather-proof side. In another embodiment, the pre-determined width comprises a total surface area for the first and second weather-proof side. However, the present invention is not limited to such embodiments and other pre-determined widths can also be used to practice the invention.

In one specific embodiment, the weather-proof flat roof material 12 is provided in roll of material of a pre-determined size comprising eighteen inches to thirty-nine inches wide and up to forty feet long and includes plural sealing components 14 of three to six inches or eighteen inches to thirty-nine inches in width. However, the present invention is not limited to such an embodiment and other pre-determined widths can also be used to practice the invention.

In one embodiment, wax paper or plastic covers are used to prevent premature adherence of the plural sealing components during installation. In one embodiment, pre-perforated peel strips are strategically placed located twelve feet in from each end of the weather-proof flat roof material for easy installation and to avoid any unnecessary scoring or cutting. In another embodiment unique perforated target marks 23 are strategically placed in a pre-determined pattern to receive fasteners in lengths from about one inch to eight inches to help prevent wind uplift of material in over 100 mph wind gusts. FIG. 2A illustrates one pre-determined pattern. However, the present invention is not limited to the illustrated pattern and other pre-determined patterns can also be used to practice the invention.

Figure 3:
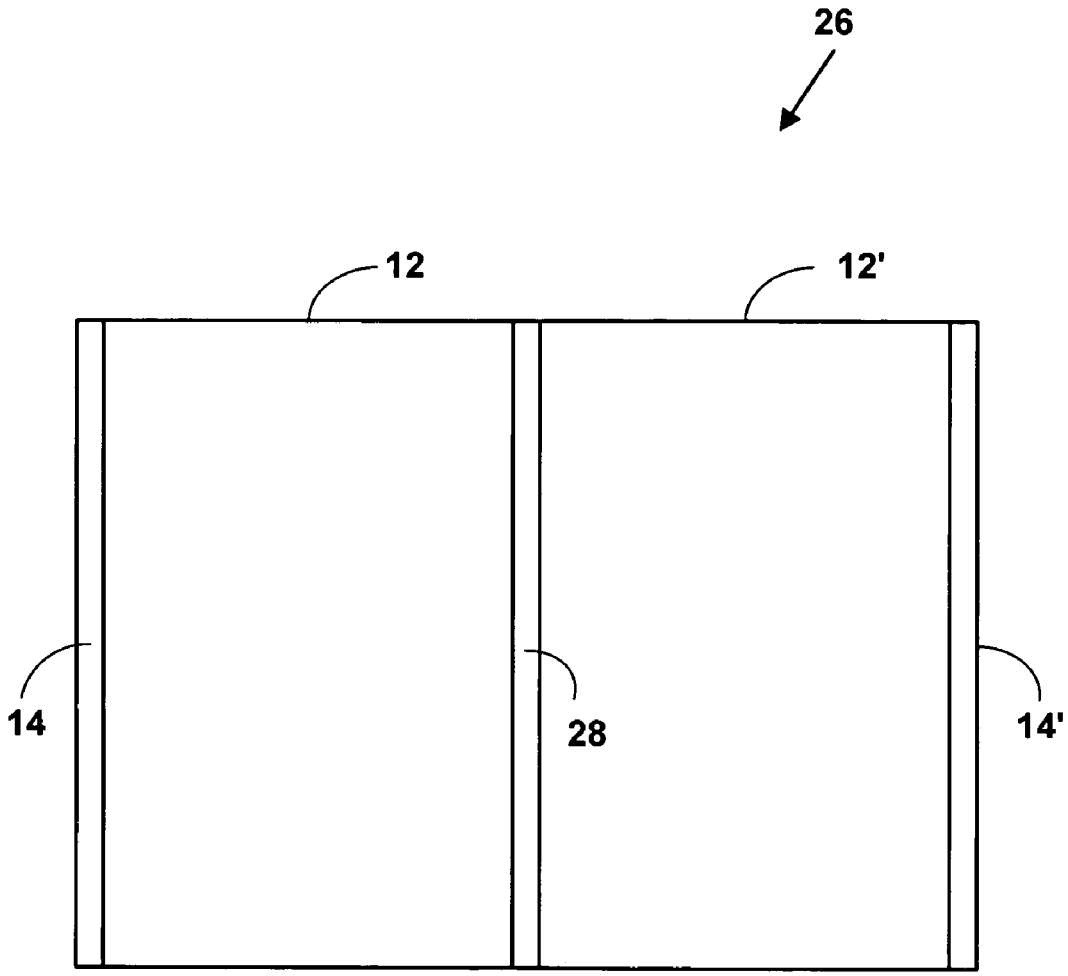
FIG. 3 is a block diagram illustrating two overlapping pieces of the weather-proof flat roof material in which two sealing components overlap to form a sealed seam.

FIG. 3 is a block diagram 26 illustrating two overlapping pieces of the weather-proof flat roof material 12 in which two sealing components 14 overlap 28 to form a sealed seam.

Figure 4:
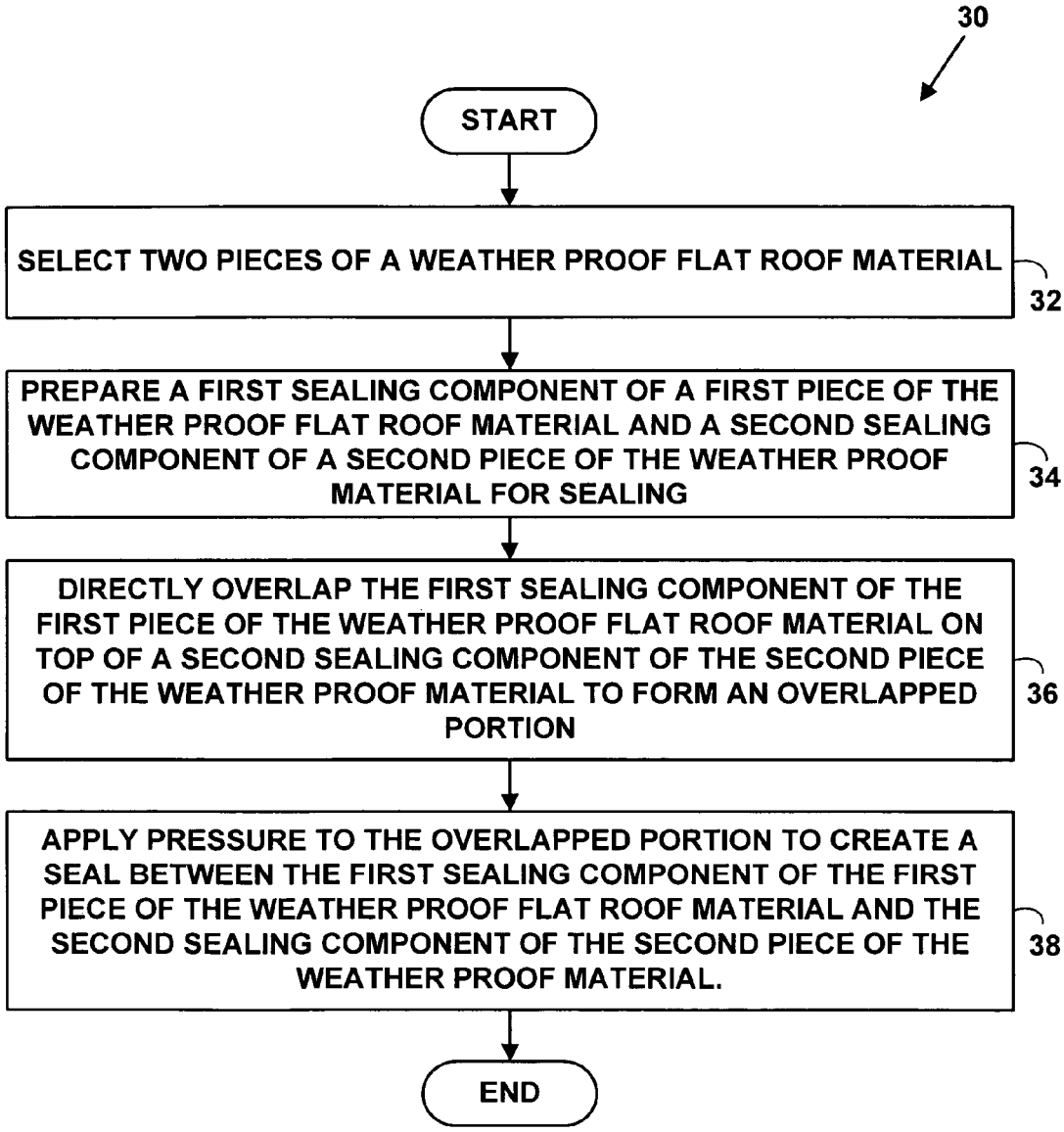
FIG. 4 is a flow diagram illustrating a method for applying a weather-proof flat roof material.

FIG. 4 is a flow diagram illustrating a Method 30 for applying a weather-proof flat roof material 12. At Step 32, two pieces of a weather-proof flat roof material 12 are selected. At Step 34, a first sealing component 14 of a first piece of the weather-proof flat roof material 12 and a second sealing component 14 of a second piece of the weather-proof flat roof material 12 are prepared for sealing. At Step 36, the first sealing component 14 of the first piece of the weather-proof flat roof material 12 is directly overlapped on top of a second sealing component 14 of the second piece of the weather-proof flat roof material 12 to form an overlapped portion 28. At Step 38, pressure is applied to the overlapped portion to create a seal between the first sealing component 14 of a first piece of the weather-proof flat roof material 12 and the second sealing component 14 of a second piece of the weather-proof flat roof material 12. There is an overlapping of three to six inches from piece one to piece two and so on.

In one embodiment, the plural sealing components 14 include a pre-applied adhesive during its manufacturing process that will permanently bond with another sealing component 14. In such an embodiment, at Step 34, the preparing step includes selecting the first and second piece. At Step 36, a first sealing component 14 of a first piece of the weather-proof flat roof material 12 is directly overlapped 28 on top of a second sealing component 14 of a second piece of the weather-proof flat roof material 12. When the first sealing component 14 and second sealing component 14 come in contact the adhesives included therein cause a chemical reaction to permanently bond to each other, thereby permanently sealing the first and second piece of weather-proof flat roof material.

In one embodiment the sealing components 14 do not include a protective covering (e.g., plastic or wax paper, other materials, etc.). In another embodiment, the sealing components 14 include a protective covering (e.g., plastic or wax paper, other materials, etc.) that needs to be removed before use at Step 34.

Figure 2B:
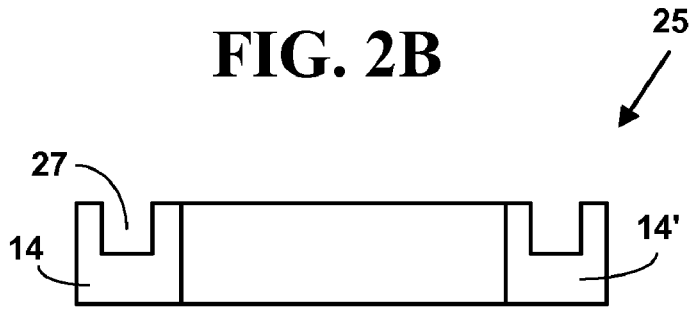

In one embodiment, the weather-proof flat roof material 12 includes sealing components 14 of a pre-determined width without an adhesive applied and with a pre-treated chemical compound. In such an embodiment, the sealing components 14 including a shallow trough 27 FIG. 2B (e.g., 1 mm) for engaging and storing an appropriate amount of an adhesive at Step 34. This adhesive must be applied to initiate sealing of two pieces of the weather-proof flat roof material 12. In such an embodiment, the adhesive is any type of weather-proof adhesive known in the roofing arts. The shallow trough in addition to engaging and storing the adhesive also allows for a vacuum seal to be created between two sealing components 14, thereby improving the seal.

In another embodiment, the weather-proof flat roof material 12 includes sealing components 14 of a pre-determined width to which roller pressure is applied to initiate sealing between two pieces of weather-proof flat roof material 12 at Step 34. In such an embodiment, the sealing components 14 are pre-treated with a pre-determined chemical compound during the manufacturing process with the appropriate chemicals that will not initiate sealing until either a rise in temperature occurs, a pressing of the two pieces occurs and/or fasteners are installed to initiate sealing of sheet and adherence.

In one embodiment, the weather-proof flat roof material 12 includes sealing components 14 of a pre-determined width without an adhesive applied and with a pre-treated chemical compound. In such an embodiment, the sealing components 14 including a shallow trough 27 FIG. 2B (e.g., 1 mm) for engaging and storing an appropriate amount of an adhesive at Step 34. This adhesive must be applied to initiate sealing of two pieces of the weather-proof flat roof material 12. In such an embodiment, the adhesive is any type of weather-proof adhesive known in the roofing arts. The shallow trough in addition to engaging and storing the adhesive also allows for a vacuum seal to be created between two sealing components 14, thereby improving the seal.

In all of these embodiments, two pieces of weather-proof flat roof material 12 are sealed by applying pressure at Step 38 to the overlapping sealing components 28. In one embodiment, this pressure is applied by hand with a rubber roller or other type of pressure roller (e.g., a water-filled or heavy metal roller, etc.) that can be used to apply the appropriate amount of pressure to the overlapping sealing components 28. A specialized automated rolling tool can also be used to apply pressure to overlapping sealing components 28.

In one embodiment, the weather-proof flat roof materials 12 include, but are not limited to, polyester, fiberglass, cured neoprene, uncured neoprene, polyvinyl chloride (PVC), chlorinated polyethylene, butyl, asphalt, fiberglass reinforced asphalt, thermoplastic elastomer (TPE), polytetrafluoroethylene (PTFE) polyisobutylene or rubber based adhesive and polyester fiber materials.

In one embodiment, the weather-proof flat roof materials 12 include, but are not limited to, about 100 square feet (i.e., 1 square), that is, about three feet wide by about 33.34 feet in length with a thickness of about 1.5 mm and with a sealing component 14 of about three to six inches in width. However, the present invention is not limited to this embodiment and other lengths and widths can also be used to practice the invention.

In one embodiment, the weather-proof flat roof materials 12 can be used over plywood, perlit, concrete, wood fiber, etc. or used as a base for other flat roof materials.

In one embodiment the weather-proof flat roof materials 12 include, but are not limited to multiple colors including black, white, gray, red, blue, green and yellow.

In one embodiment, the weather-proof flat roof materials 12 include an upper surface (e.g., first weather-proof side) coated with a texturing material (e.g., natural or artificial sand or gravel size, etc.) and a lower smooth surface (e.g., second weather-proof side) not coated with the texturing material. In another embodiment, the weather-proof flat roof materials 12 include an upper surface with a textured pattern to simulate roofing shingles. In another embodiment, the weather-proof flat roof materials 12 include a textured pattern to simulate roofing tiles. In another embodiment, the weather-proof flat roof materials 12 include a custom pattern customizable to a user preference.

In one embodiment, the weather-proof flat roof materials 12 include twenty-four pieces of one foot by one foot squares with a thickness of about 1.5 mm and with a sealing component 14 of about two inches. The one foot square of the weather-proof flat roof materials are used around roof features including a roof entry feature 16, a roof drain 18 and a chimney 20.

In one embodiment, the weather-proof flat roof materials 12 can be used for, but are not limited to, a base layer, a ply layer used between a base layer and a cap layer, a cap layer, as flashings, on walls or as a substrate layer.

In all these embodiments, there is no need for an open flame to create a seal a first and second piece of weather-proof flat roof materials 12.

Figure 5:
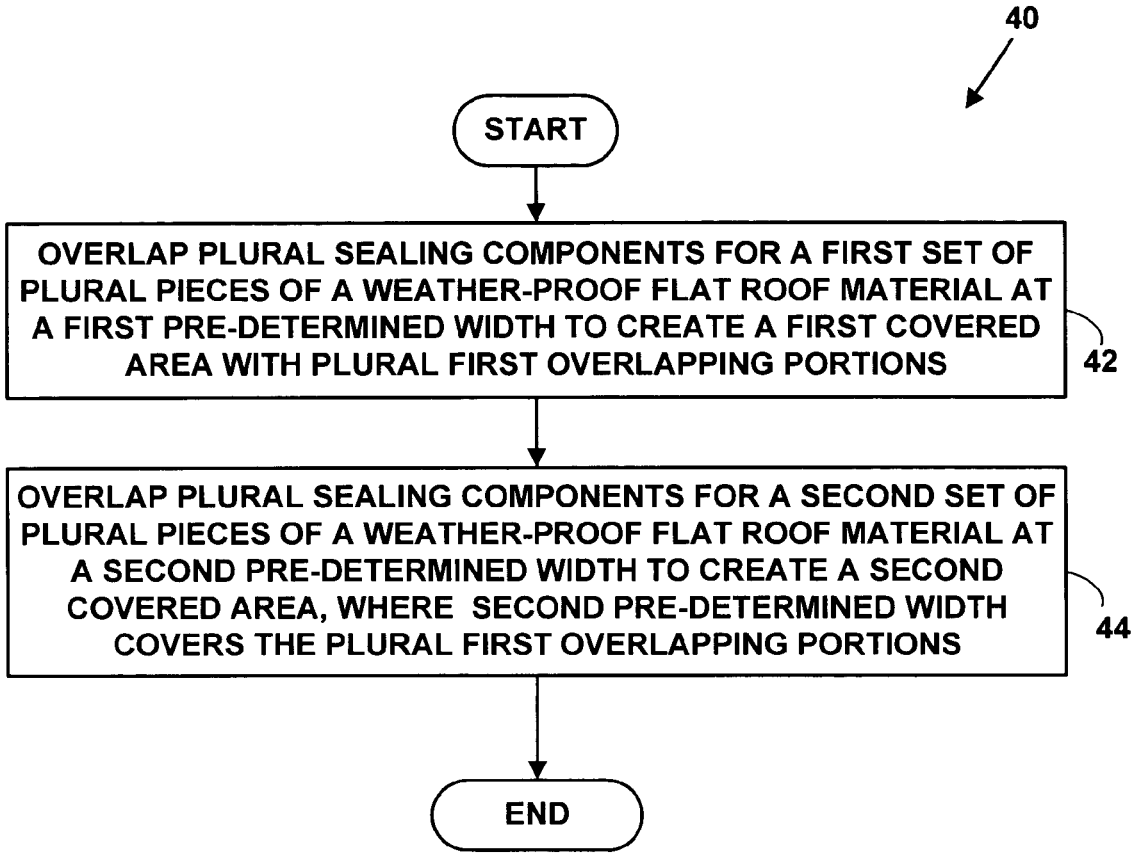
FIG. 5 is a flow diagram illustrating a method for applying a weather-proof flat roof material.

FIG. 5 is a flow diagram illustrating a Method 40 for applying a weather-proof flat roof material. At Step 42, plural sealing components for a first set of plural pieces of a weather-proof flat roof material are overlapped at a first pre-determined width to create a first covered area with plural first overlapping portions. At Step 44, plural sealing components for a second set of plural pieces of a weather-proof flat roof material are overlapped at a second pre-determined width to create a second covered area. The second pre-determined width covers the plural first overlapping portions.

Method 40 is illustrated with one exemplary embodiment. However, the present invention is not limited to such an embodiment and other embodiments can also be used to practice the invention.

In such an exemplary embodiment at Step 42, plural sealing components 14 for a first set of plural pieces of a weather-proof flat roof material 12 are overlapped at a first pre-determined width to create a first covered area with plural first overlapping portions. In one embodiment, the pre-determined width includes three inches to six inches. In another embodiment, the first covered area is a base layer that covers a total area for a flat roof. In another embodiment, the first covered area includes only a portion of the total area for the flat roof. However, the present invention is not limited to these embodiments and other embodiments can also be used to practice the invention.

Figure 6:
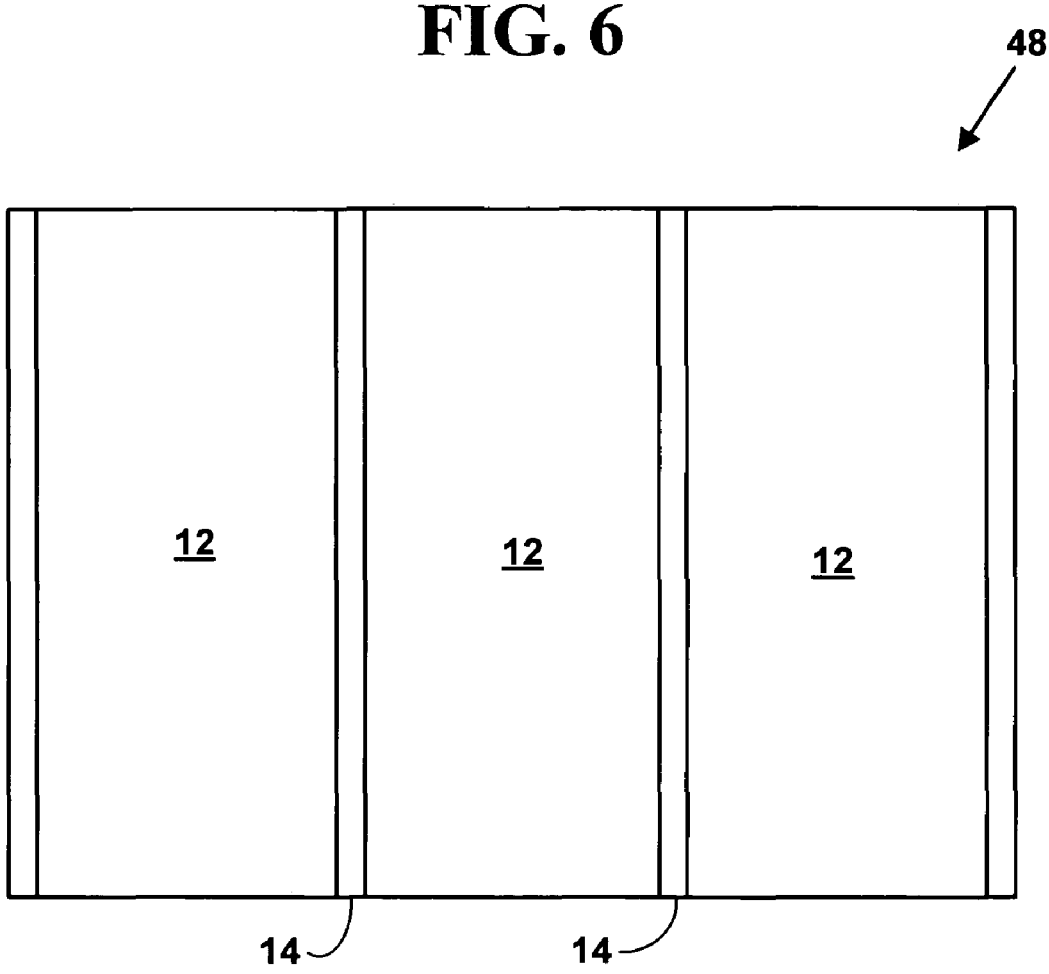
FIG. 6 is a block diagram illustrating overlapping plural sealing components for a first set of plural pieces of a weather-proof flat roof material.

FIG. 6 is a block diagram 48 illustrating overlapping plural sealing components 14 for a first set of plural pieces of a weather-proof flat roof material at Step 42. In one embodiment, the second covered area is a surface layer that covers a total area of the first covered area which covers a total area for a flat roof. In another embodiment, the second covered area includes only a portion of first covered area and only a portion of the total area for the flat roof.

The plural set of first overlapping portions cover a flat roof and provide a first layer of protection for a flat roof with a limited number of "joints" in which weather elements can attack a flat roof.

Returning to FIG. 5 at Step 44, plural sealing components 14 for a second set of plural pieces of a weather-proof flat roof material 12 are overlapped at a second pre-determined width to create a second covered area. The second set of plural pieces of the weather-proof flat roof material 12 are overlapped at an offset width so the second set of plural pieces of the weather do not overlap or align with overlapping portions of the first set of plural pieces. This overlapping schema provides a second layer with a limited number joints in which weather elements can attack a flat roof. However, since the second layer of overlapping portions do not align with the first layer, should a weather element (e.g., water) get through a joint on the second layer it will hit a non-overlapping portion of the first layer, thereby protecting the flat roof and providing better protection from water entering a building with a roof that has standing or ponding water on it.

Figure 7:
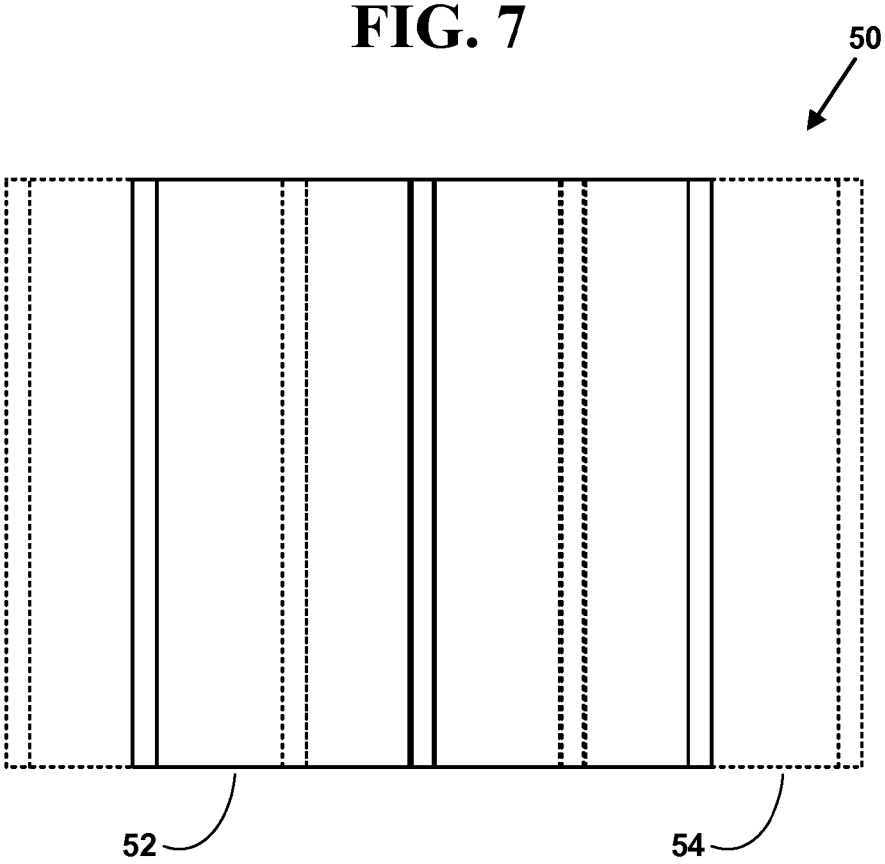
FIG. 7 is a block diagram illustrating overlapping plural sealing components for a second set of plural pieces of a weather-proof flat roof material.

FIG. 7 is a block diagram 50 illustrating overlapping plural sealing components 14 for a second set of plural pieces of a weather-proof flat roof material at Step 44. In FIG. 7, the second set of plural pieces of weather-proof flat roof materials 12 are illustrated with solid lines 52 and the first set of plural pieces of weather-proof flat roof materials 12 are illustrated with dashed lines 54.

FIGS. 6 and 7 illustrate a rectangular area of a flat roof. However, Method 40 can also be used to cover a flat roof of any shape (e.g., circular, oval, square, etc.).

Method 40 was illustrated to cover a flat roof with two layers. However, the Steps of Method 40 can be repeated as many times a necessary to create plural layers to protect a flat roof. For example, plural rows of overlapping pieces of weather-proof flat roof materials can be laid down as a base layer with each row overlapping a portion of an adjacent row. A surface layer is then laid down over the base layer wherein the overlapping pieces of the surface layer offset as to not align with any of the overlapping vertical joints of the base layer. The surface layer is also laid down at an offset as to not align with any horizontal joints of the base layers. This overlap provides protection for the flat roof providing better protection from water entering a building with a roof that has standing or ponding water on it.

The method and system include a weather-proof flat roof material 12 with plural sealing components 14 that do not require an open flame (e.g., from a blow torch) to seal a first and second piece of weather-proof flat roof material 12 together. The weather-proof flat material 12 can be used as a base layer, a ply layer used between a base layer and a cap layer, a cap layer, as flashings, on walls or as a substrate layer for flat roofs.

It should be understood that the processes, methods and system described herein are not related or limited to any particular type of component unless indicated otherwise. Various combinations of general purpose, specialized or equivalent components combinations thereof may be used with or perform operations in accordance with the teachings described herein.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more or fewer or equivalent elements may be used in the block diagrams.

The claims should not be read as limited to the described order or elements unless stated to that effect. In addition, use of the term "means" in any claim is intended to invoke 35 U.S.C. §112, paragraph 6, and any claim without the word "means" is not so intended.

Therefore, all embodiments that come within the scope and spirit of the following claims and equivalents thereto are claimed as the invention.

I claim:

1. A weather-proof fiat roof material for protecting flat roofs, comprising:

a first weather-proof side with a pre-applied adhesive applied to a plurality of sealing components including a trough of a pre-determined depth for engaging and storing an appropriate amount of the pre-applied adhesive, the trough offset a pre-determined distance inward from outer edges around a perimeter portion of a pre-determined width of the first weather-proof side that will permanently bond to other sealing components including a pre-applied adhesive on other sides of another weather-proof flat roof material and to other pieces of the weather-proof flat roof material, wherein the plurality of sealing components are included only in the perimeter portion of the pre-determined width of the first weather proof side;

a second weather-proof side with a pre-applied adhesive applied to a plurality of sealing components around a second perimeter portion of a second pre-determined width of the second weather-proof side that will permanently bond to other sealing components including the pre-applied adhesive on other sides of another weather-proof flat roof material and to other pieces of the weather-proof flat roof material, wherein the plurality of sealing components are included only in the second perimeter portion of the second pre-determined width of the second weather proof side, wherein the plurality of sealing components including the pre-applied adhesive cause a chemical reaction when pressed together to permanently bond to each other, thereby permanently sealing two or more pieces of the weather-proof flat roof material together and preventing leaks;

a plurality of perforated target marks placed in a pre-determined pattern to receive fasteners through the weather-proof flat roof material to fasten it to a surface; and a pre-determined size, shape and amount of the weather-proof flat roof material for applying as a base layer, a ply layer between a base layer and a cap layer, a cap layer, flashings, on walls or as a substrate layer for flat roofs.

2. The weather-proof flat roof material of claim 1 wherein the weather-proof flat roof material includes a weather-resistant elastomer or plastomer.

3. The weather-proof flat roof material of claim 1 wherein the weather-proof flat roof material includes polyester, fiberglass, cured neoprene, uncured neoprene, polyvinyl chloride, chlorinated polyethylene, butyl, asphalt, fiberglass reinforced asphalt, thermoplastic elastomer (TPE), polytetrafluoroethylene (PTFE), polyisobutylene, rubber based adhesive or polyester fiber materials.

4. The weather-proof flat roof material of claim 1 wherein the pre-determined width and the second pre-determined width further includes a pre-determined width of three to six inches or eighteen to thirty-nine inches.

5. The weather-proof flat roof material of claim 1 wherein the trough allows for a vacuum seal to be created between two sealing components, thereby improving the seal.

6. The weather-proof flat roof material of claim 1 wherein the pre-applied adhesive includes a chemical compound that will not initiate sealing until a chemical solvent is applied, wherein the chemical solvent reacts with the chemical compound to initiate sealing.

7. The weather-proof flat roof material of claim 1 wherein the weather-proof flat roof material comprise multiple colors including black, white, gray, red, blue, green or yellow.

8. The weather-proof flat roof material of claim 1 wherein the weather-proof flat roof material includes a thickness of 1.5 millimeters.

9. The weather-proof flat roof material of claim 1 wherein the plurality of sealing components of the first weather-proof side are coated with a texturing material.

10. The weather-proof flat roof material of claim 9 wherein the texturing material includes a natural or artificial sand or gravel size texturing material.

11. The weather-proof flat roof material of claim 1 wherein the plurality of sealing components of the first weather-proof side include a textured pattern to simulate roofing shingles, roofing tiles or a customized textured pattern.

12. The weather-proof flat roof material of claim 1 wherein the plurality of sealing components include a protective covering.

13. The weather-proof flat roof material of claim 1 wherein the weather-proof flat roof material includes a roll of weather-proof flat roof material comprising a coverage size of one roofing square or cover one hundred square feet with a plurality of sealing components with a width of three to six inches or eighteen to thirty-nine inches.

14. The weather-proof flat roof material of claim 1 wherein the weather-proof flat roof material includes twenty-four pieces of one foot by one foot squares with a thickness of 1.5 millimeters and with a plurality of sealing components with a width of two inches.

15. Weather-proof flat roof material of claim 1 wherein perforated target marks are placed in a pre-determined pattern to receive fasteners which help prevent wind uplift of the weather-proof flat roof material from a surface.

16. The weather-proof flat roof material of claim 1 wherein the pre-determined depth of the trough includes a pre-determined depth of one millimeter.

17. A weather-proof flat roof material for protecting flat roofs, comprising:

a weather-proof means including a plurality of perforated target marks placed in a pre-determined pattern to receive fasteners through the weather-proof means to fasten it to a surface; and a plurality of connection means for connecting a piece of the weather-proof flat roof material to another piece of the weather-proof flat roof material, wherein the connection means includes a plurality of sealing components around a perimeter portion of a pre-determined width of a first-side and a second-side of the weather-proof means with a pre-applied adhesive applied, the sealing components of the first side include a trough of a pre-determined depth for engaging and storing an appropriate amount of the pre-applied adhesive to permanently bond two or more pieces of the weather-proof flat roof material together, the trough offset a pre-determined distance inward from outer edges around the perimeter of the first-side and wherein the plurality of sealing components are included only in the perimeter portion of the pre-determined width of the first-side and the second-side;

wherein the plurality of connection means including the pre-applied adhesive cause a chemical reaction when pressed together to permanently bond to each other, thereby permanently sealing two or more pieces of the weather-proof flat roof material together and preventing leaks; and a pre-determined size, shape and amount of the weather-proof flat roof material for applying as a base layer, a ply layer between a base layer and a cap layer, a cap layer, as flashings, on walls or as a substrate layer for flat roofs, wherein a first top side of the weather proof means includes a textured pattern to simulate roofing shingles, roofing tiles or a custom pattern.

* * * * *